United States Patent [19]

Morin et al.

[11] Patent Number: 4,766,615

[45] Date of Patent: Aug. 30, 1988

[54] SAFETY HELMET

[76] Inventors: Claude Morin, Peymeinade, France; T.A.C. (Tongerese Automaten Centrale), 03, Tongeren, Belgium

[21] Appl. No.: 77,813

[22] Filed: Jul. 27, 1987

[30] Foreign Application Priority Data

Aug. 1, 1986 [EP] European Pat. Off. ..... 86201350.5

[51] Int. Cl.[4] ..... A42B 1/08; A42B 3/02; A42B 7/00

[52] U.S. Cl. ..... 2/421; 2/410; 2/424

[58] Field of Search ..... 2/6, 9, 10, 410, 421, 2/424

[56] References Cited

U.S. PATENT DOCUMENTS

| | | | |
|---|---|---|---|
| 3,478,365 | 11/1969 | Varga | 2/424 |
| 4,573,222 | 3/1986 | Zago | 2/424 |
| 4,581,774 | 4/1986 | Chaise | 2/424 X |
| 4,641,382 | 10/1987 | Gessalin | 2/421 |
| 4,689,836 | 9/1987 | Vitaloni | 2/9 X |

FOREIGN PATENT DOCUMENTS

| | | |
|---|---|---|
| 0097285 | 1/1984 | European Pat. Off. . |
| 2846636 | 4/1980 | Fed. Rep. of Germany . |
| 3144872 | 9/1983 | Fed. Rep. of Germany . |

*Primary Examiner*—Stuart S. Levy
*Assistant Examiner*—Thomas R. Hannon
*Attorney, Agent, or Firm*—Cushman, Darby & Cushman

[57] ABSTRACT

A safety helmet comprising a shell and a chin-strap associated thereto, the one chin-strap end being rotatably mounted on a pivot fastened to the shell, the other chin-strap end being joined to the shell through a control member rotatably mounted on a pivot fastened to the shell, and so arranged as to move the chin-strap between two end positions, a first position allowing either fitting the helmet on, or removing the head therefrom, wherein the chin-strap projects in front of the chin to make the helmet opening completely free, and a second position corresponding to securing the helmet, wherein that chin-strap portion intended to bear under the chin to secure the helmet, is bearing underneath the chin.

10 Claims, 3 Drawing Sheets

SAFETY HELMET

This invention relates to a safety helmet for engine driver or passengers, comprising a rigid, impact-withstanding shell for protecting the forehead, the skull top, the temples, the skull occipital area, as well as the nape, and a chin-strap associated with said shell for securing the helmet and avoid same being stripped away by impacts.

Various solutions have already been proposed to try, on the one hand, to insure for a helmet the protecting function thereof for the head and nape whatever be the stresses it does undergo under impacts, and on the other hand to prevent the helmet being stripped away due to such impacts and this while trying to retain in the helmet some comfort, some use ease and a possibility of removing the helmet after same has undergone some distortion due to an accident. Such various solutions have however for drawback that they leave gaps in one or the other areas as defined hereinabove.

The invention has for object to obviate said drawback and to provide a helmet the single-part shell of which is so designed as to have an equal strength over the whole surface area thereof and to thus insure an efficient protection for all the vulnerable and fragile portions of the head and nape, said helmet further having the following advantages: easy and automatic securing of the helmet by means of the hinged chin-strap thereof, high ease of fitting on and removing from the head, locking of the chin-strap in operating position to prevent stripping the helmet away due to impacts and whatever be the impact direction, and possibility of removing the helmet even when the shell thereof has been distorted.

For this purpose, according to the invention, the one chin-strap end is rotatably mounted on a pivot secured to the shell and the axis of which lies substantially in parallel relationship with a straight line passing through the ears, the other chin-strap end being joined to the shell through means provided with a control member which is rotatably mounted on a pivot secured to the shell and with an axis lying substantially parallel to said straight line, said means being so arranged as to move the chin-strap between two end positions, a first position allowing either fitting the helmet on, or removing same from the head, wherein the chin-strap projects frontwards relative to the chin to leave the helmet opening completely free, and a second position corresponding to securing the helmet in position, wherein that chin-strap portion intended to bear under the chin to secure the helmet, is bearing underneath the chin, said means being further so arranged on the one hand when the chin-strap is moved from the first to the second end position thereof, to have each point from said chin-strap portion describe substantially an arc of circle the center of which lies on the pivot axis whereabout the control member revolves to go round the chin and then, when said portion lies facing that location where it bears underneath the chin to secure the helmet, to impart to said chin-strap portion a substantially straight translation movement in the direction of said pivot axis to bear firmly underneath the chin, and on the other hand when the chin-strap moves from the second to the first end position, to have said chin-strap portion move away from the chin with a substantially straight translation movement to move away from said pivot axis to then describe the substantially circular movement thereof to move about the chin and release the helmet opening, said means comprising means for locking the chin-strap as it lies in the second end position thereof.

In a particular embodiment of the invention, both chin-strap ends are linked to the shell through said means which are identical and comprise each said control member and the means for locking the chin-strap in position, said control members being mounted on pivots fastened to the shell and the axes of which merge and lie substantially in parallel relationship with the straight line passing through the ears.

In an advantageous embodiment of the invention, the control means for said means are joined together by a hoop, said hoop being so arranged as to lie in front of the chin, to leave the helmet opening completely free when the chin-strap lies in the first end position thereof.

In a particularly advantageous embodiment of the invention, said hoop is so shaped as to comprise a chin-piece.

Other details and features of the invention will stand out from the following description, given by way of non limitative example and with reference to the accompanying drawings, in which.

Figure 7:
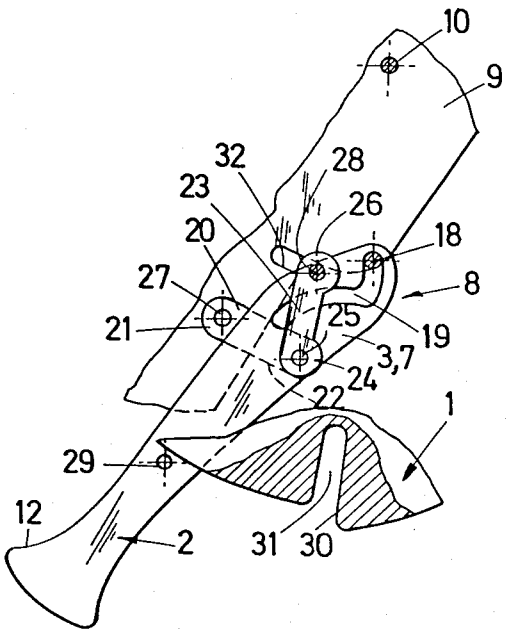
Figure 6:
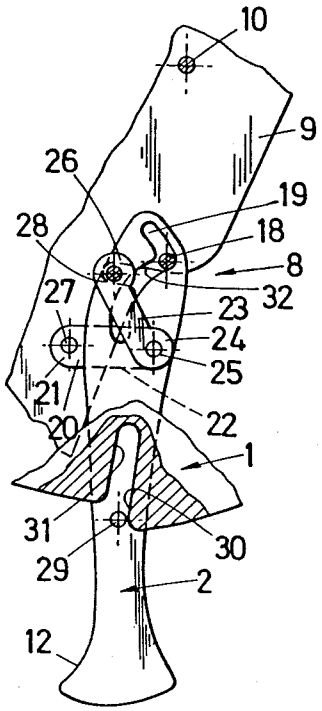
Figure 5:
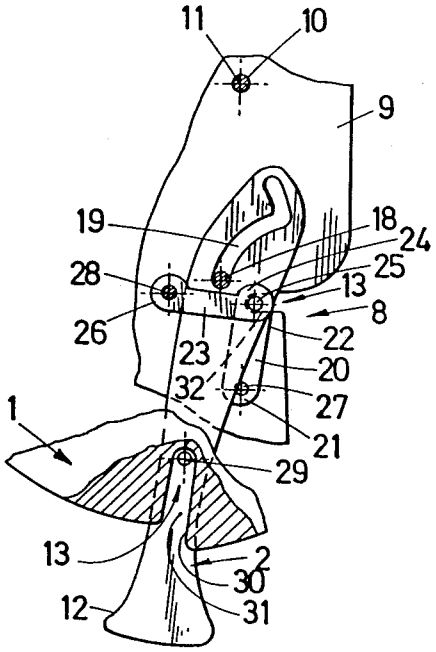

FIGS. 5, 6 and 7 are diagrammatical elevation views showing in detail those means associated with one or both chin-strap ends for assembling same with the helmet shell, FIG. 5 showing said means in that position they lie in when the chin-strap lies in the second end position thereof corresponding to the helmet securing position, FIG. 7 showing said means in that position they lie in when the chin-strap lies in the first end position thereof corresponding to that position allowing fitting on and removing the helmet, while FIG. 6 shows said means in an intermediate position which corresponds to that time where the chin-strap passes from the rotation movement to the translation movement thereof and vice-versa.

Figure 8:
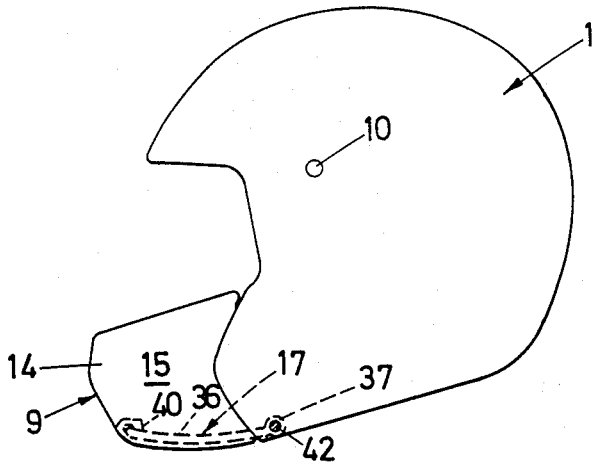

FIG. 8 is a diagrammatic elevation view showing details of the invention.

Figure 9:
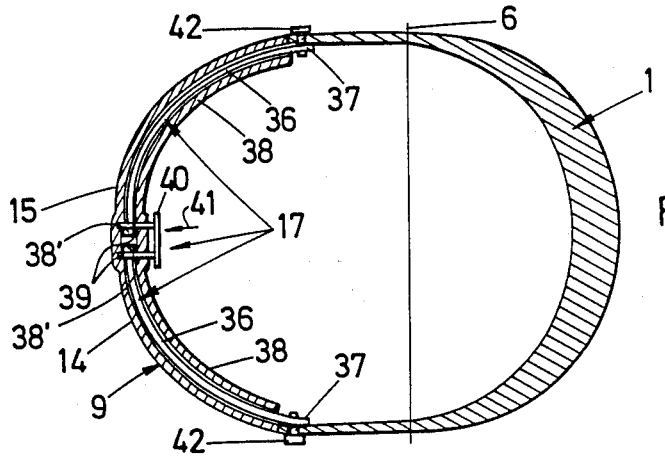
Figure 10:
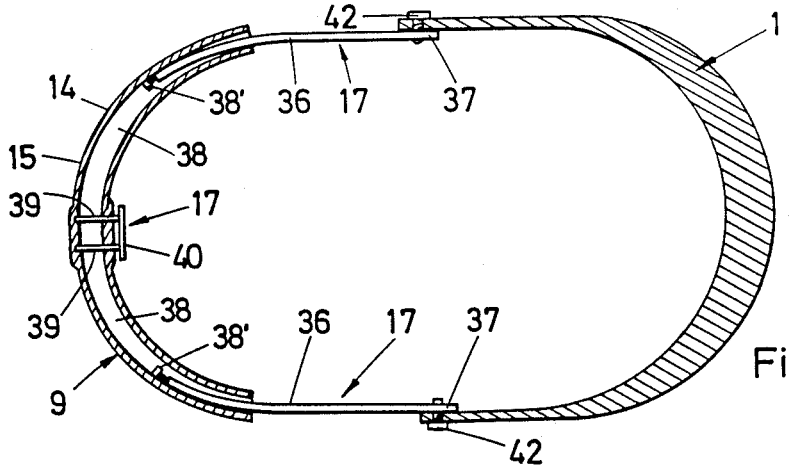

FIGS. 9 and 10 are plan and section views corresponding to FIG. 8 and showing the components illustrated therein in two different positions.

In the various figures, the same reference numerals pertain to identical or similar elements.

Figure 1:
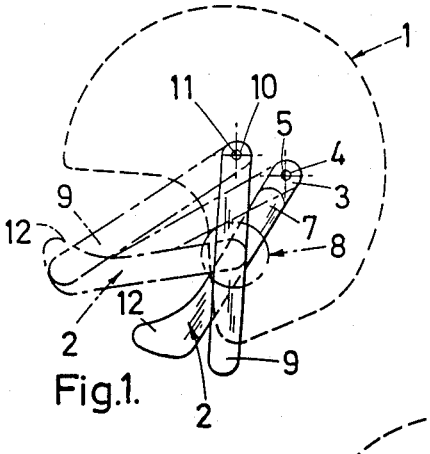
FIG. 1 is a diagrammatic elevation view showing one embodiment of the helmet according to the invention, the chin-strap and the control member thereof being shown in solid lines in that end position thereof which corresponds to securing the helmet in position, and in broken lines in the other end position.

The helmet according to the invention and shown in the drawings comprises a shell 1 (shown in dotted lines in FIGS. 1 to 3), made as a single part from a rigid, impact-withstanding material, which is intended to protect all the vulnerable portions from the head, that is at least the forehead, the skull top, the temples, the skull occipital portion, as well as the nape, and a chin-strap 2 associated with the shell 1 to secure the helmet firmly in position and prevent stripping same away under an impact, whatever be the direction thereof. In the helmet embodiment as shown in FIG. 1, the end 3 from chin-strap 2 is rotatably mounted on a pivot 4 fastened to the shell and the axis 5 of which is parallel with a straight line 6 (FIG. 9) passing through the ears, the end 7 from chin-strap 2 being joined to the shell 1 through means 8 comprising a control member 9 rotatably mounted on a pivot 10 fastened to said shell 1 and with an axis 11 substantially prallel to said straight line 6. Said means 8 are so arranged as to move the chin-strap 2 between two end positions, a first position (shown in broken lines) allowing either to fit the helmet on, or to remove the head therefrom, wherein the chin-strap projects frontwards of the chin to completely release the opening lying at the helmet bottom, and a second position (shown in solid lines) corresponding to securing the helmet in position, wherein that portion 12 from chin-strap 2 intended to bear under the chin to secure the helmet, is bearing underneath the chin. The means 8 are further so arranged as to have on the one hand, when the chin-strap 2 is moved from the first to the second end position thereof, each point from said chin-strap portion 12 substantially describe an arc of circle the center of which lies on the axis of said pivot 10 whereabout the control member 9 revolves to go round the chin and then, when said chin-strap portion 12 lies facing the location where it bears under the chin to secure the helmet in position, to impart to said chin-strap portion 12 a substantially straight translation movement in the direction of the axis 11 of pivot 10 to move closer to the chin and bear firmly underneath the chin, and on the other hand when the chin-strap 2 goes from the second to the first end position thereof, the chin-strap portion 12 moves away from the chin with a substantially straight translation movement to move away from pivot axis 11 and to then describe the substantially circular movement thereof to go round the chin and completely release the opening lying at the helmet bottom, said means 8 further comprising locking means 13 (FIG. 5) to lock same in position when said chin-strap lies in the second end position thereof, and to thus let the chin-strap efficiently oppose stripping the helmet away whatever be the stresses it does undergo due to impacts.

Figure 2:
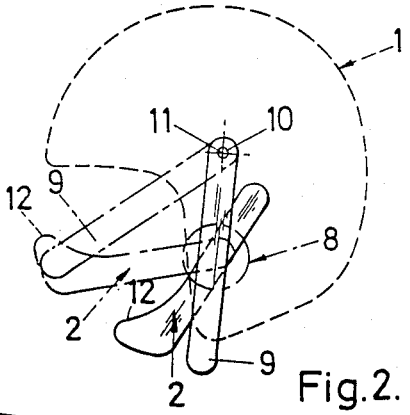
FIG. 2 is a view similar to FIG. 1, showing a variation of the helmet as shown in FIG. 1, the chin-strap and the control member thereof being shown respectively in solid lines and in broken lines, in both said end positions.

In the embodiment of the helmet as shown in FIG. 2, both ends 3 and 7 from the chin-strap 2 are each joined to the shell 1 through means 8 as described hereinabove. Said means 8 associated with said chin-strap ends 3 and 7, are identical and comprise each a control member 9 and locking means 13 for the chin strap when same lies in the second end position thereof, both control members 9 being mounted on two pivots 10 fastened to shell 1. The axes 11 of said pivots 10 merge and are substantially parallel with said straight line 6. The control members 9 are to be operated separately and simultaneously to cause the chin-strap 2 to go from the first position to the second end position thereof and vice-versa.

Figure 3:
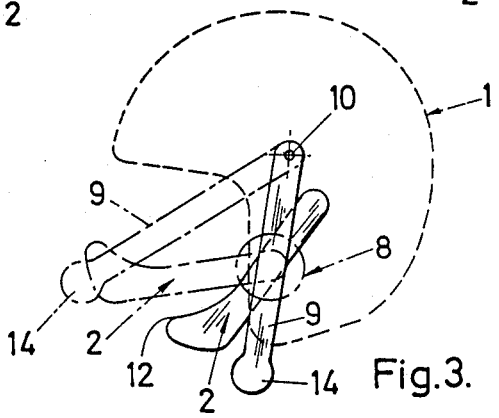
FIGS. 3 and 4 are also views similar to FIG. 1, showing two other variations of the helmet according to the invention.
Figure 4:
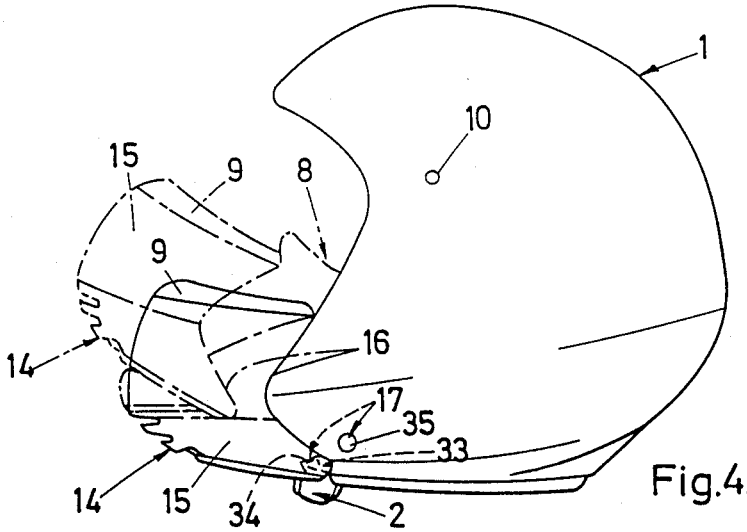

To make controlling the chin-strap 2 easier and possible with a single hand, the control members 9 are advantageously joined together as shown in FIG. 3, by a hoop 14 joining the ends of said members 9 opposite pivots 10. Said hoop 14 is so arranged as to be projectable in front of the chin, to completely release the opening lying at the helmet bottom, when the members 9 lie in the position thereof which corresponds to the first end position of the chin-strap 2. Said hoop 14 is advantageously so shaped as shown in FIG. 4, as to comprise in the case of a so-called "integral" helmet, a chin-piece 15 for protecting the chin from impacts. Said chin-piece 15 is advantageously so shaped as to adapt to the shape of shell 1 and bear thereon, along lines 16, when the chin-strap 2 lies in the second end position thereof and to let those stresses resulting from impacts on the chin-piece be conveyed to shell 1.

To prevent the helmet being stripped away in the case of an impact, the chin-strap locking means 13 are so arranged as to oppose when the chin-strap 2 lies in the second end position thereof, that is as it presses against the chin, any rotating movement of said chin-strap 2 about the axis 11 of the pivot or pivots 10 from the single control member or both control members 9, and to any cross-wise movement of said chin-strap, in the one or the other direction, relative to said axis 11.

To prevent an accidental displacement with an impact, of the control member or members 9, the helmet according to the invention advantageously comprises as shown in FIGS. 4 and 8 to 10, securing means 17 for the control member or members relative to shell 1. Said means 17 are so arranged as to oppose any rotation movement of the member or members 9 about the axis 11 of the pivot or pivots 10, when they lie in that position thereof which corresponds to the second end position of chin-strap 2, that is in the securing position of the helmet.

As shown in FIGS. 5 to 7, the means 8 wherethrough the end or ends 3 and 7 of chin-strap 2 are mounted on helmet shell 1, comprise a lug 18 fastened to said shell with the axis thereof in parallel relationship with said straight line 6 going through the ears, a notch 19 so shaped as to insure the rotation and translation movements of chin-strap 2, provided on the chin-strap end (3, 7) and wherein the lug 18 is movable, a first link 20 the end 21 of which is swingably mounted on control member 9, while the other end 22 thereof is swingably mounted on chip-strap end 3, 7, a second link 23 the end 24 of which is swingably mounted on chin-strap 2 about an axis common with said first link 20, and the other end 26 of which is swingably mounted on helmet shell 1, the axes 25, 27 and 28 of links 20 and 23 being parallel with said straight line 6. Said means 8 further comprise a lug 29 with an axis parallel with straight line 6, fastened to chin-strap 2 and intended to engage as said chin-strap moves from the first end position to the second end position thereof, a ramp 30 provided in the helmet shell 1, to enter a straight recess 31 provided in said shell and facing the pivot 10 whereabout the control member 9 rotates.

Said locking means 13 for the chin-strap 2 when same lies in the second end position thereof, that is the position thereof for securing the helmet, are comprised on the one hand of said recess 31 which captures the lug 29 and prevents thereby any rotation movement of the chin-strap 2, and on the other hand of a second recess 32 provided in the control member 9 and extending along a direction substantially at right angle to recess 31. Inside said recess 32 is received the common axis 25 of links 20 and 23, the capture of said axis 25 inside said recess 32 opposing any chin-strap translation movement to move towards or away from that pivot 10 the control member 9 is hinged on.

Said securing means 17 of the control member or members 9 relative to the helmet shell 1 when the chin-strap 2 lies in the position thereof for securing the helmet in position (second end position) may be comprised as shown in FIG. 4, of a male element 33 fastened to the shell and of a corresponding female element 34 provided in member 9, said elements being so arranged as to insure the automatic locking of member 9 on shell 1 when said member 9 lies in that position thereof corresponding to the second end position of chin-strap 2, a control knob 35 being provided on the shell to insure unlocking of member 9.

Said securing means 17 may also be comprised as shown in FIGS. 8 to 10, of two flexible elements 36 fastened with the end 37 thereof, to shell 1 and sliding inside two channels 38 provided at the bottom of chin-piece 15. The ends 38' of elements 36 are so shaped as to enter automatically the clamps 39 from a bolt 40 which retains same firmly when the chin-strap lies in that position thereof which corresponds to securing of the helmet (FIG. 9). The bolt 40 is so designed that a pressure being exerted along the direction of arrow 41 and from inside the helmet, does release the elements 36 and allows moving the chin-piece 15 (FIG. 10) which projects the chin-strap 2 in front of the chin. To enable moving the chin-piece in that case where same is distorted, which would prevent the elements 36 sliding inside the channels 38, said flexible elements 36 are joined to the helmet shell 1 by means of screws 42 which, as they are unscrewed, allow releasing the ends 37 of said elements 36.

It must be understood that the invention is in no way limited to the described embodiments and that many changes may be brought thereto without departing from the scope of the invention as defined by the appended claims.

For instance, on the one hand, the means 8 might be comprised of cams which would impart to the chin-strap 2, the above-described movement, and on the other hand, the locking means 13 and securing means 17 might be comprised of automatically-locking bolts.

What is claimed is:

1. Safety helmet for engine driver or passengers, comprising a rigid, impact-withstanding shell for protecting the forehead, the skull top, the temples, the skull occipital portion, as well as the nape, and a chin-strap associated with said shell for securing the helmet in position and prevent same being stripped away by impacts, in which the one chin-strap end is rotatably mounted on a pivot fastened to the shell and the axis of which substantially lies in parallel relationship with a straight line passing through the ears, the other chin-strap end being joined to the shell through means provided with a control member which is rotatably mounted on a pivot fastened to the shell and with an axis substantially parallel with said straight line, said means being so arranged as to move the chin-strap between two end positions, a first position allowing either fitting the helmet on, or removing the head therefrom, wherein the chin-strap projects in front of the chin to leave the helmet opening completely free, and a second position corresponding to securing the helmet in position, wherein that chin-strap portion intended to bear under the chin, is bearing underneath the chin, said means being further so arranged on the one hand when the chin-strap is being moved from the first to the second end position thereof, to have each point from said chin-strap portion describe substantially an arc of circle the center of which lies on the axis of that pivot whereabout the control member revolves to go round the chin and then, when said portion lies facing the location where it bears under the chin to secure the helmet in position, to impart to said chin-strap portion a substantially straight translation movement in the direction of said pivot axis, to bear firmly underneath the chin, and on the other hand, when the chin-strap moves from the second to the first end position thereof, said chin-strap portion moves away from the chin with a substantially straight translation movement to move away from said pivot axis to then describe the substantially circular movement thereof so as to go round the chin and release the helmet opening, said means comprising locking means for the chin-strap when same lies in the second end position thereof.

2. Helmet as defined in claim 1, in which both chin-strap ends are joined to the shell through said means which are identical and comprise each said control member and chin-strap locking means, said control members being mounted on pivots fastened to the shell and the axes of which merge and are substantially parallel with that straight line passing through the ears.

3. Helmet as defined in claim 2, in which the control members for said means are joined together by a hoop, said latter hoop being so arranged as to lie in front of the chin to completely release the helmet opening, when the chin-strap lies in said first end position thereof.

4. Helmet as defined in claim 3, in which said hoop is so shaped as to comprise a chin-piece.

5. Helmet as defined in claim 4, in which said chin-piece is so arranged as to bear on the helmet shell when the chin-strap lies in said second end position thereof.

6. Helmet as defined in claim 1, in which said locking means for the chin-strap are so arranged as to oppose when said chin-strap lies in the second end position thereof, any rotation movement of said chin-strap about the axis of the pivot of a control member, and any chin-strap cross-wise movement relative to said axis.

7. Helmet as defined in claim 1, wherein further comprises means for securing said control member relative to the helmet shell, which are so arranged as to oppose the rotation movement of said control member about said pivot, when the control member lies in that position thereof corresponding to the chin-strap second end position.

8. Helmet as defined in claim 1, in which said means wherethrough the chin-strap end or ends are mounted on the helmet shell, comprise a lug fastened thereto and with an axis parallel with said straight line passing through the ears, a notch so shaped as to insure the chin-strap rotation and translation movements, provided on the chin-strap end and wherein the lug can move, a first link the one end of which is swingably mounted the control member, while the other end thereof is swingably mounted on the chin-strap end, a second link the one end of which is swingably mounted on the chin-strap about an axis common to the first link, and the other end of which is swingably mounted on the helmet shell, the link swinging axes being parallel with said straight line, said means further comprising a lug with an axis in parallel relationship with said straight line, fastened to the chin-strap, so designed as to engage when the chin-strap moves from the first to the second end position thereof, a ramp provided in the helmet shell, to enter a recess provided therein and facing that pivot the control member revolves about, the means for locking the chin-strap in the second position thereof being comprised of said recess which prevents any chin-strap rotation movement, and of a second recess so provided in the control member as to extend along a direction substantially at right angle to said recess and wherein the common axis of both said links is received, which prevents any chin-strap translation movement.

9. Helmet as defined in claim 7 or claim 8, in which the means for securing the control member relative to the helmet shell when the chin-strap lies in the second end position thereof, are comprised of male and female elements fastened respectively to the shell and the control member, and so arranged as to cooperate due to an automatic mutual locking, when said control member lies in the position thereof corresponding to the chinstrap second end position.

10. Helmet as defined in claim 9, in which one said male or female elements is fastened either to the helmet shell, or to the control member, in such a way as to be removable.

* * * * *